United States Patent [19]

Grimm et al.

[11] 4,168,037

[45] Sep. 18, 1979

[54] WINDING APPARATUS

[75] Inventors: Eberhard Grimm; Gerd Hüsges, both of Ingolstadt, Fed. Rep. of Germany

[73] Assignee: Schubert & Salzer, Ingolstadt, Fed. Rep. of Germany

[21] Appl. No.: 874,621

[22] Filed: Feb. 2, 1978

[30] Foreign Application Priority Data

Feb. 12, 1977 [DE] Fed. Rep. of Germany ..... 2706018

[51] Int. Cl.[2] ..... B65H 54/42; B65H 59/38

[52] U.S. Cl. ..... 242/18 DD; 57/263; 242/36; 242/45

[58] Field of Search ..... 242/18 DD, 45, 36, 18 R, 242/75, 75.5; 57/34 R, 263

[56] References Cited

U.S. PATENT DOCUMENTS

| | | | |
|---|---|---|---|
| 3,300,830 | 1/1967 | Johnson, Jr. | 242/45 X |
| 3,357,649 | 12/1967 | Nichols et al. | 242/45 |
| 3,844,504 | 10/1974 | Lawson | 242/45 X |
| 3,860,186 | 1/1975 | Schiltknecht et al. | 242/45 |
| 3,891,155 | 6/1975 | Naegeli | 242/45 |
| 3,905,560 | 9/1975 | Trifunovic et al. | 242/45 X |
| 3,945,579 | 3/1976 | Schippers et al. | 242/18 DD |
| 4,019,691 | 4/1977 | Wroclawski et al. | 242/45 |

*Primary Examiner*—Stanley N. Gilreath
*Attorney, Agent, or Firm*—Bailey, Dority & Flint

[57] ABSTRACT

A winding apparatus including a winding roll driving a bobbin and a yarn reservoir arranged between a yarn supply point and the winding roll. The state of filling of the reservoir is monitored by a monitoring device which generates a signal for controlling the speed of the winding roll. Interposed between a driven drive shaft and the winding roll are a pair of intermediate wheels which are selectively brought into engagement with the drive shaft and the winding roll responsive to predetermined states of filling of yarn on the reservoir that is sensed by the monitoring device so as to either drive the winding roll at speed higher or lower than the delivery speed at the yarn delivery point. A brake lever is operably connected to a mechanism which supports the intermediate wheels and is brought into contact with the winding roll when both the intermediate wheels are out of engagement with the shaft and winding roll for stopping the winding roll.

9 Claims, 3 Drawing Figures

1
2
3
4
5
6
7
10
11
12
13
14
15
16
21
22
23
24
25
26
27
28
29
30
31
32
50
70
71
72
73
74
75
76
77
78

WINDING APPARATUS

BACKGROUND OF THE INVENTION

The present invention relates to a winding apparatus which includes a winding roll driving a bobbin and a yarn reservoir arranged between a yarn supply point and the winding roll. The state of filling of the reservoir is monitored by a monitoring device which controls the speed of the winding roll.

A device of this type is known (West German Offenlegungsschrift No. 2,242,151) in connection with an open end spinning apparatus, with the winding roll driven via a freewheel coupling at a speed which is less than the speed at which the yarn is withdrawn from the yarn supply point and stored in the yarn reservoir. In order to be able to empty the filled reservoir again, the winding roll is driven from time to time by an intermediate drive at a higher speed, which is made possible by the freewheel coupling. Since the drive takes place either directly or via this intermediate drive, with such an apparatus the winding of a single spinning position hence can never be interrupted, if this is necessary on occurrence of a yarn break or another work operation such as, e.g., knotting. Since a sufficient yarn reserve must also always be available for this case, a very large yarn reservoir is hence required which can store 100 m and more.

SUMMARY OF THE INVENTION

In accordance with the invention, a winding roll is mounted parallel to and spaced from a drive shaft and can be driven according to the state of filling of the yarn reservoir alternatively by one of two intermediate wheels which are interposed between the drive shaft and the winding roll.

Both of the intermediate wheels can be brought simultaneously into an inoperative position. The speed ratios for the two intermediate wheels are chosen so that the peripheral speed of the winding roll is higher with the one intermediate wheel, and lower with the other intermediate wheel, than the delivery speed of the yarn delivery point. A monitoring device monitors the yarn reservoir and, via a suitable control connection, brings the one or the other intermediate wheel into operation according to the state of filling of the yarn reservoir, so that the windup speed brings about a rundown or a build-up of the amount of yarn stored. For bringing the winding apparatus to rest, both intermediate wheels can also be brought into an inoperative position. This takes place when the whole machine is switched off at the main switch. For individually bringing to rest single winding positions, an individual switch can be provided. So that the winding position concerned is automatically stopped when a malfunction occurs at a single working position, according to a further feature of the invention, the two intermediate wheels are connected for control purposes to a yarn monitor which monitors the yarn between the yarn delivery point and the yarn reservoir.

In order to obtain a particularly rapid arrest of the winding roll and, with it, of the bobbin driven by this winding roll, a common brake lever is advantageously connected to the control device for the two intermediate wheels, and is brought into contact with the winding roll when both intermediate wheels are brought into the inoperative position. This can, for example, take place by means of a separate drive which is controlled in dependence on the position of the two intermediate wheels. The brake lever, which is elastically urged in the direction towards the winding roll, advantageously has a stop face for each intermediate wheel, cooperating with a respective stop that is connected to the intermediate wheel. In this way, a separate drive for the brake lever is not required. The brake lever expediently has a friction lining at its working end. So that the brake lever can be quickly replaced when the brake lining wears away, the brake lever is preferably interchangeably mounted on its pivot axis.

To obtain a good braking action without large external control forces being required, the brake lever comes into contact at its working end or its brake lining with respect to the plane passing through the axis of the winding roll and the axis of the brake lever, with the half of the winding roll which moves towards this plane during winding.

Accordingly, it is an object of the present invention to provide a winding apparatus which makes possible the use of a smaller yarn reservoir than is normal by selectively driving the winding roll at two different fast speeds.

Another important object of the present invention is to provide a winding apparatus which enables yarn to be uniformly wound on a bobbin.

Still another important object of the present invention is to provide a simple, reliable apparatus for controlling the winding of yarn from an open end spinning apparatus.

Still another important object of the present invention is to provide a winding apparatus which simply and efficiently controls the speed of winding of yarn on a bobbin and also breaks the bobbin responsive to a predetermined condition.

These and other objects and advantages of the invention will become apparent upon reference to the following specification, attendant claims, and drawing.

DESCRIPTION OF THE PREFERRED EMBODIMENT

Figure 1:
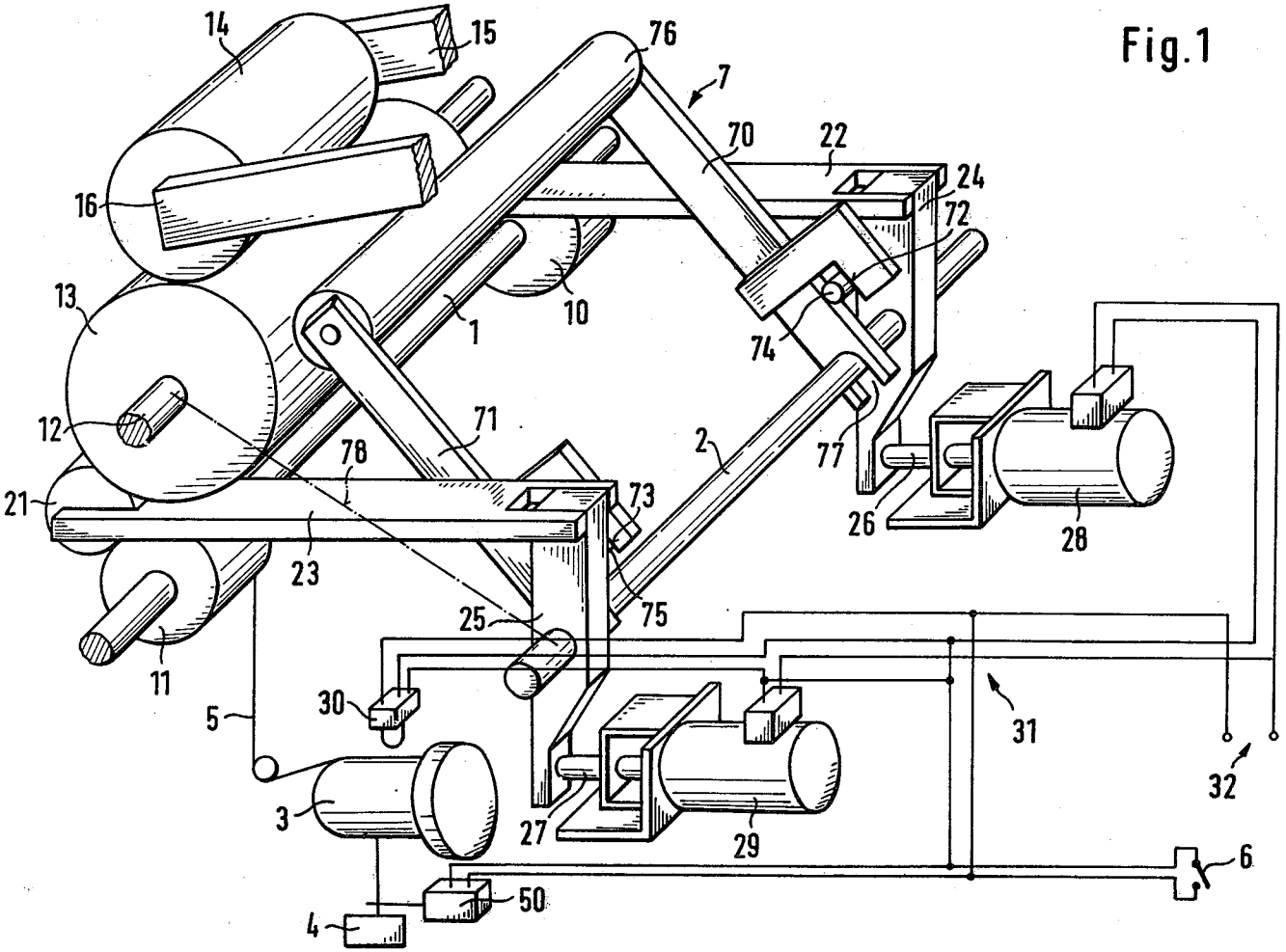
FIG. 1 is a perspective view of the winding apparatus according to the invention with its control connections.
Figure 3:
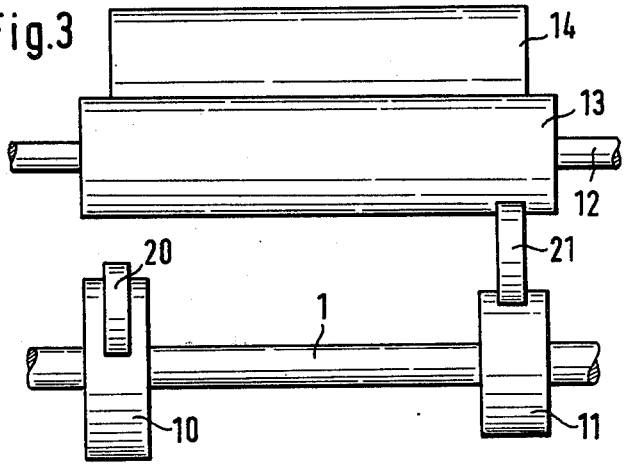
FIG. 3 diagrammatically shows the drive connection, via an intermediate wheel, of the apparatus according to the invention.

The winding apparatus shown in FIG. 1 has a drive shaft 1 which extends over several winding positions and on which two drive pulleys 10 and 11 per winding position are mounted. It is also possible to make the drive pulleys 10 and 11 integral with the drive shaft. A winding roll 13 is mounted, parallel to and spaced from the drive shaft 1, on a shaft 12. The bobbin 14 is supported on the winding roll 13 and is itself carried by bobbin arms 15 and 16. Two intermediate wheels 20 and 21 (FIG. 3) act as the drive connection between the drive shaft 1 and the winding roll 13, and can be interposed alternatively between the drive shaft 1 and the winding roll 13, so that the winding roll 13 is driven by the drive shaft 1 either via the drive pulley 11 and the intermediate wheel 21 or via the drive pulley 10 and the intermediate wheel 20. As shown in FIG. 3, the drive pulley 11 is, for example, smaller than the drive pulley 10, while the intermediate wheels 20 and 21 are of equal size. Consequently with the drive as shown, the winding roll 13 is driven via the drive pulley 11 and the intermediate wheel 21 at a lower speed than via the drive pulley 10 and the intermediate wheel 20.

Each intermediate wheel 20 or 21 is mounted on a lever 22 or 23 respectively which is in turn pivotably jointed to a drive lever 24 or 25. The two drive levers 24 and 25 are pivotably mounted on a shaft 2. Each of the drive levers 24, 25 is connected to the armature 26 or 27, respectively, of an electromagnet 28 or 29.

A yarn reservoir 3 is set up in the yarn path of the winding apparatus and, in the embodiment shown, is constructed as a roller reservoir. The yarn reservoir 3 stores the yarn 5 supplied from a yarn delivery point 4 between two boundary values, and is monitored by a monitoring device 30. The monitoring device 30 is connected by leads 31 with a source of current 32 and with the electromagnets 28 and 29, such that either the electromagnet 28 or the electromagnet 29 is addressed.

The apparatus according to the invention operates as follows: The monitoring device 30, for example, constructed as a beam of light measures the reflection of light from the yarn reservoir 3. When a sufficient reserve of yarn is lacking, much light will be reflected whereupon in order to build up a larger reserve of yarn, the winding roll 13 is driven at a speed which is lower than the supply speed of the yarn supply point 4. For this purpose, the electromagnet 29 is excited and by means of its armature 27, pivots the drive lever 25 about the shaft 2 and hence brings the intermediate wheel 21, via the lever 23, into simultaneous contact with the drive pulley 11 of the drive shaft 1 and with the winding roll 13.

If, on the other hand, no light is reflected from the body of the yarn reservoir because of the presence of a sufficient yarn reserve, the electromagnet 28 will be addressed, while the previously excited electromagnet 29 drops out. The intermediate wheel 20 is brought, via the armature 26, the drive lever 24, and the lever 23, into the driving position between the drive pulley 10 and the winding roll 13 while because the electromagnet 29 is no longer excited, the intermediate wheel 21 returns to its inoperative position. By the constant change of the drive via the two intermediate wheels 20 and 21, the amount of yarn stored in or on the yarn reservoir 3 is always kept between given boundary values, as the bobbin 14 winds up the yarn 5 at a correspondingly changing speed.

It is, of course, possible to construct the monitoring device 30 in other ways, in particular if the yarn reservoir 3 is also not constructed as a roller reservoir.

So that the winding positions can be individually stopped, a switch 6 is provided by which both electromagnets 28 and 29 can simultaneously be addressed via the leads 31. In addition, there can be provided a further main switch, by means of which the two electromagnets 28 and 29 of all the winding positions can be simultaneously addressed. The simultaneous addressing of the electromagnets 28 and 29 causes both intermediate wheels 20 and 21 to be brought into their inoperative positions, so that the winding roll 13 and, hence, also the bobbin 14 are brought to rest.

So that the winding positions can also be individually stopped when a malfunction occurs, and in order in this way to prevent an emptying of the yarn reservoir 3 below the lower tolerance limit, as a result of which the yarn reservoir 3 can become completely emptied and also the yarn end can become unwound, the intermediate wheels 20 and 21, with their electromagnets 28 and 29, are connected for control with a yarn monitor 50 which monitors the yarn 5 between the yarn supply point 4 and the yarn reservoir 3. This yarn monitor 50 is connected in parallel with the switch 6 or even replaces it, so that when the yarn monitor 50 is released by a drop in the yarn tension, both electromagnets 28 and 29 are excited so that both intermediate wheels 20 and 21 move to their inoperative position. The yarn monitor 50 makes it possible for the windup of the winding position to be stopped earlier enough that the yarn reservoir 3 is not emptied, so that in a known way an automatic back-supply of yarn 5 to the yarn supply point is possible.

The electrical connections are only shown schematically in FIG. 1. Diodes or other elements for preventing incorrect connections are for this reason not shown, although they are usually provided.

Instead of the drive pulleys 10 and 11 being of different size and the intermediate wheels 20 and 21 being of equal size, it is also possible for the intermediate wheels 20 and 21 to be made of different sizes while the drive pulleys 10 and 11 are equal in size. If necessary, with this construction, the drive pulleys 10 and 11 can even be completely dispensed with and the intermediate wheels 20 and 21 can be supported directly on the drive shaft 1.

For a particularly rapid stopping of the winding roll 13 and with it also of the bobbin 14 driven by the winding roll 13 and, because of its large mass, moreover, and the accompanying inertia, continuing to turn together with the winding roll 13, a brake lever 7 is provided as shown in FIG. 1. This brake lever 7 is controlled in dependence on the control of the intermediate wheels 20 and 21 such that it comes into contact with the winding roller 13 when the switch 6 or the main switch are actuated, or also when the yarn monitor 50 trips out. Thus, an electromagnet (not shown) can be actuated by the switch 6, the main switch, and/or the yarn monitor 50, via the circuit they control, and actuates the brake lever 7.

If the winding roll 13 is a grooved roller, the braking surface of the brake lever 7 which comes into contact with the winding roll is wider than the widest place of the groove located in its region of action.

The brake lever 7 can advantageously be elastically pressed by a spring or by its own weight against the winding roll 13.

In order to eliminate a separate control drive for the brake lever 7, the brake lever 7 has a stop surface 72 or 73 for each respective intermediate wheel 20 or 21 and cooperating with a corresponding stop 74 or 75 connected to the respective intermediate wheel 20 or 21. In the embodiment shown in FIG. 1, the brake lever 7 has two parallel arms 70 and 71 which are mounted at one end on the shaft 2 that carries the drive levers 24 and 25 and which are connected together at their other ends by a connecting piece that is formed as a brake surface or carries a brake lining 76. The embodiment shown has a connecting piece and brake lining 76 with a round cross section so that after loosening of the mounting (not shown) the connecting piece with the brake lining 76 can be turned, or the brake lining 76 can be turned on the connecting piece so that another point of its periphery comes to be in the working position.

When both intermediate wheels 20 and 21 move into their inoperative position, both stops 74 and 75 release the arms 70 and 71 of the brake lever 7 so that this moves with its brake lining 76 into contact with the winding roll 13 and brakes it and hence also the bobbin 14. If, however, at least one of the intermediate wheels 20 and 21 is in the operative position, the brake lever 7 is lifted from the winding roll 13 by the stop connected to the other intermediate wheel so that the brake lever 7 is inoperative.

There is a large enough play between the arm 70 and the stop surface 72, or between the arm 71 and the stop surface 73, so that the required movement is available for one of the intermediate wheels 20 or 21 to be brought into its inoperative position.

The stop 74 or 75 need not be provided on the drive lever 24 or 25, but can instead of this be fitted also on the lever 22 or 23. In this case, the undersides of the arms 70 and 71 form the stop surfaces 72 and 73.

Figure 2:
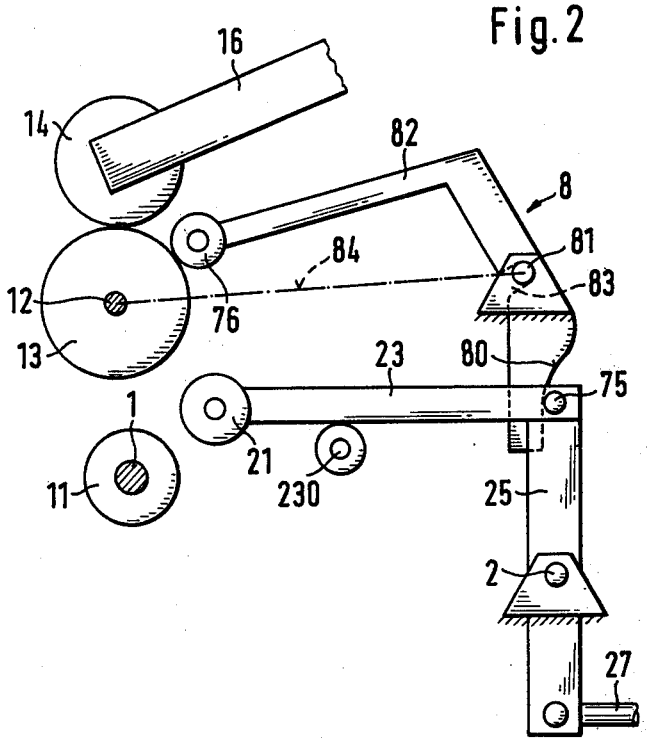
FIG. 2 is a diagrammatic side view of another embodiment of the invention.

FIG. 2 shows another embodiment of the invention, in which the intermediate wheels 20 and 21 are not arranged as in the example shown in FIG. 1, on the side remote from their drive, but on their side facing their drive. Support rollers 230 are, for example, provided for the levers 22 and 23. In this embodiment, the brake lever 8 is constructed as a two-armed lever which is mounted on a stationary shaft 81 and which abuts with its stop face 80 located on its rearward arm on the stop 75 that simultaneously forms the link between the drive lever 25 and the lever 23. The brake lining 76 is provided on the forward arm 82. The brake lever 8 is here also in its rest position when one of the intermediate wheels 20 and 21 is in the working position while the brake lever 8 is in the braking position when both intermediate wheels 20 and 21 are in their inoperative position.

The brake lining 76 naturally wears away with time so that replacement is required. In order to be able to effect this replacement without interrupting the winding process, the brake lever 7 or 8 has a slot-shaped recess 77 (FIG. 1) or 83 (FIG. 2) by means of which it is mounted on the shaft 2 (FIG. 1) or 81 (FIG. 2), so that the removal of the brake lever 7 or 8 is effected by merely pulling it off.

As shown in FIGS. 1 and 2, the brake lever 7 or 8 is arranged with its brake lining 76 such that the latter, with respect to the plane 78 or 84 passing through the axis 12 and the axis 2 (FIG. 1) or through the axis 12 and the axis 81 (FIG. 2), always abuts the half of the winding roll 13 whose surface moves during winding of the yarn towards the brake lining 76 so that the braking action is even further amplified by the entrainment of the brake lever 7 or 8 by the winding roll 13.

While a preferred embodiment of the invention has been described using specific terms, such description is for illustrative purposes only, and it is to be understood that changes and variations may be made without departing from the spirit or scope of the following claims.

What is claimed is:

1. A winding apparatus including a winding roll driving a bobbin and a yarn reservoir arranged between a yarn supply point and the winding roll, the state of filling of the reservoir being monitored by a monitoring device which controls the speed of the winding roll, the improvement comprising:

a driven drive shaft;

means for mounting said winding roll parallel to and spaced from said drive shaft;

a pair of intermediate wheels interposed between said drive shaft and said winding roll;

means for selectively connecting one of said pair of wheels to said drive shaft and said winding roll responsive to a first predetermined state of filling of said reservoir being sensed by said monitoring device for driving said winding roll at a first speed; and means for selectively connecting the other of said pair of wheels to said drive shaft and said winding roll responsive to another predetermined state of filling of said reservoir being sensed by said monitoring device for driving said winding roll at a second speed different from said first speed.

2. The winding apparatus as set forth in claim 1 further comprising:

means for monitoring said yarn between said yarn delivery point and said yarn reservoir and generating a signal responsive to a drop in tension in said yarn; and said means for selectively connecting one of said pair of wheels and the other of said pair of wheels being de-activated responsive to said signal indicating a drop in yarn tension so that both wheels are out of engagement with said drive shaft.

3. The winding apparatus as set forth in claim 2 further comprising:

a brake means connected to said means for selectively connecting one of said pair of wheels and the other of said pair of wheels for being brought into contact with said winding roll to stop said winding roll when both wheels are out of engagement with said drive shaft.

4. A winding apparatus including a winding roll driving a bobbin and a yarn reservoir arranged between a supply point and the winding roll, the state of filling the reservoir being monitored by a monitoring device, the improvement comprising:

a driven shaft;

means for mounting said winding roll parallel to and spaced from said drive shaft;

a pair of intermediate wheels interposed between said drive shaft and said winding roll;

a respective pivotal arm rotatably supporting each of said pair of intermediate wheels;

means for moving one of said arms bringing one of said wheels into engagement with said drive shaft and said winding roll responsive to a first predetermined state of filling of said reservoir being sensed by said monitoring device for driving said winding roll at a first speed; and means for moving the other of said arms bringing the other of said wheels into engagement with said drive shaft and said winding roll responsive to a second predetermined state of filling of said reservoir being sensed by said monitoring device for driving said winding roll at a second speed different from said first speed.

5. The winding apparatus as set forth in claim 4 further comprising:

a brake lever;

means biasing said brake lever towards said winding roll; and stop means operably connected between each of said intermediate wheels and arms and said brake lever preventing said brake lever from engaging said winding roll when one of said wheels is in engagement with said winding roll and said driven shaft.

6. The winding apparatus as set forth in claim 5 further comprising:

a brake lining carried on an end of said brake lever for engaging said winding roll.

7. The winding apparatus as set forth in claim 5 further comprising:

means for pivotally mounting said brake lever on an axis.

8. The winding apparatus as set forth in claim 7 further comprising:

means for mounting said brake lever so that said brake lever comes in contact by its brake lining with respect to a plane passing through the axis of said winding roll and the axis of said brake lever with the half of the winding roll whose surface moves towards said plane.

9. The apparatus as set forth in claim 4 wherein each of said means for moving said arms comprises:

an electromagnet operably connected to a respective arm and said monitoring device for moving said arm responsive to receiving a signal from said monitoring device.

* * * * *